United States Patent [19]

Jones

[11] 4,382,273

[45] May 3, 1983

[54] SEWING MACHINE LIGHT FIXTURE

[76] Inventor: Orval Jones, 2609 Cowley Way, San Diego, Calif. 92110

[21] Appl. No.: 264,287

[22] Filed: May 18, 1981

[51] Int. Cl.[3] ..... D05B 79/00

[52] U.S. Cl. ..... 362/90; 362/362; 362/368

[58] Field of Search ..... 362/90, 362, 368

[56] References Cited

U.S. PATENT DOCUMENTS 1,783,519 12/1930 Packer ..... 362/90

2,007,794 7/1935 Dawson ..... 362/90

2,226,689 12/1940 Barber ..... 362/90

*Primary Examiner*—Stephen J. Lechert, Jr.

*Attorney, Agent, or Firm*—Brown & Martin

[57] ABSTRACT

A light assembly for a sewing machine includes a housing of a generally half shell configuration having an open side adapted to mount in a vertical position on a vertical planar face at the head of a sewing machine and includes an opening at the lower end of the housing with a light disposed inside the housing and adapted to project light on the foot and needle of the sewing machine.

3 Claims, 5 Drawing Figures

SEWING MACHINE LIGHT FIXTURE

BACKGROUND OF THE INVENTION

The present invention relates to light fixtures and pertains particularly to a special light fixture for sewing machines.

It is important to have adequate lighting when utilizing a sewing machine. While many light fixtures are available which may provide adequate light under most circumstance, most of such fixtures are inconvenient for a variety of reasons. Preferably the light is positioned to shine directly on the place of sewing, namely the needle and foot of the sewing machine during sewing operation without shining into the eyes and and blinding the sewing machine operator. Moreover, it is desirable that the light be located and positioned so as not to interfere with manipulation of the machine or the material being sewn.

Ceiling and overhead lights are generally inadequate because of their distance from the needle and foot of the sewing machine and because it is necessary to carefully position the sewing machine which may not be possible in order to obtain the appropriate light.

Lights placed or mounted on the sewing machine have proven unsatisfactory because they tend to either interfere with the manipulation of the machine itself or with the material being sewn. Adjustable floor or stand lights and table lights or lamps are for the most part unsatisfactory for this reason.

It is therefore desirable that a simple, inexpensive and effective light be available that is convenient and easy to use with sewing machines.

SUMMARY AND OBJECTS OF THE INVENTION

It is the primary object of the present invention to provide an improved sewing machine light.

In accordance with the primary aspect of the present invention a sewing machine light assembly includes a housing adapted to be fitted to the head of a sewing machine and direct light directly onto the needle and foot of the machine during sewing operation.

BRIEF DESCRIPTION OF THE DRAWINGS

The above and other objects and advantages of the present invention will become apparent from the following description when read in conjunction with the drawings wherein.

DETAILED DESCRIPTION OF A PREFERRED EMBODIMENT

Figure 1:
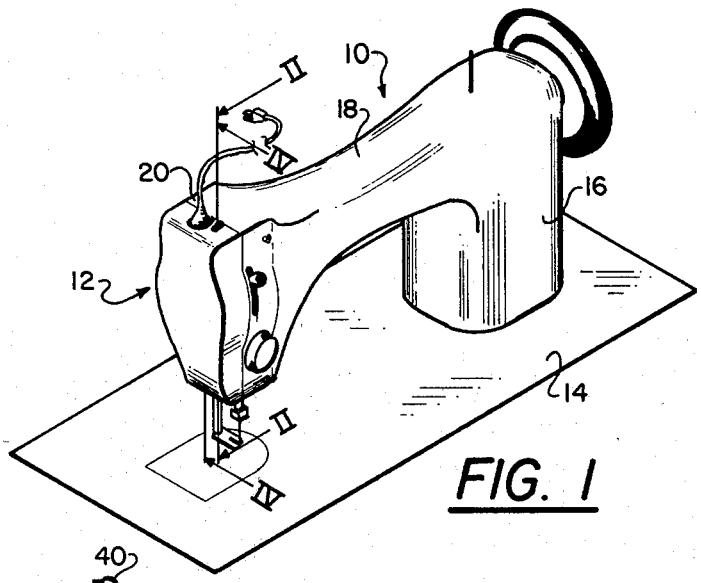
FIG. 1 is a perspective view of a sewing machine having a light in accordance with the invention attached thereto.

Turning to FIG. 1 of the drawings there is illustrated a sewing machine designated generally by the numeral 10 and having a light fixture or assembly 12 in accordance with the invention mounted on the head thereof. The sewing machine illustrated is illustrative of the typical heavy duty sewing machine of the industrial type that is available and widely used in this country today. The machines are typically driven by an electrical motor not shown and are generally of substantially similar, somewhat conventional construction. The machines are typically mounted on a stand or table at a level where the worker can sit in a chair or on a stool and manipulate the machine and material from that position. The worker normally sits in a position in front of the machine such that the head of the machine where the needle is located is to the operator's left. The material being sewn is typically fed from the operator's side of the table or stand into the needle and exits from the machine away from the operator. It is important that the operator be able to see the needle and the location and positioning of the stitching with respect to seams, other stitching and the like.

The machine typically includes a flat, planar surface or platform 14 which is normally mounted to be flush with the surface of the table or platform on which the machine is mounted. The machine includes a pedestal portion 16 extending upward from the base 14 and a neck 18 extending outward from the pedestal and including a head 20 mounted on the outer end thereof. The needle, the pressure foot and the like are mounted in the head of the machine. The needle is typically mounted in the lower end of a reciprocating plunger or rod member 22 and extends through the material being sewn to a position below the surface of the platform 14 where the bobbin or other mechanism assists in making the stitching.

The typical machine includes a needle operating mechanism and the foot pressure adjusting mechanism within the head of the machine. A flat, planar cover plate 24 covers the opening into a cavity in the head 20 in which these mechanisms are positioned. The cover 24 is typically held in place on the head of the machine by means of a plurality of screws which extend into the head.

Figure 4:
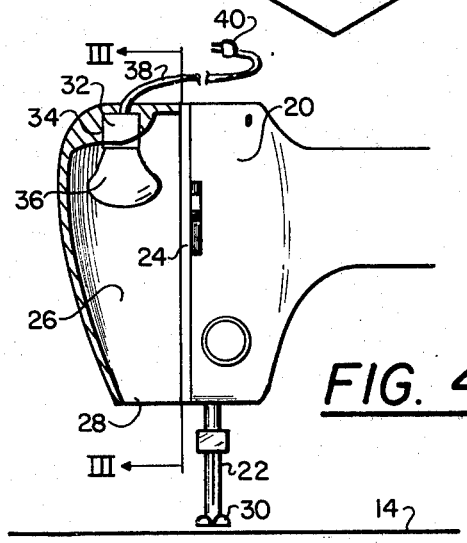
FIG. 4 is a view partially in section taken generally on line IV—IV of FIG. 1.

The light assembly of my invention is adapted to fit the head of the typical sewing machine of this type which has a flat planar surface on the outer end of the head. The light housing is typically shaped as shown in FIGS. 1–4 such as to fit either over the cover plate 24 or fit in lieu of the cover plate. In most installations I have found it most satisfactory to place the light housing or fixture in lieu of the cover 24. However, the light assembly is adapted to fit directly over the cover directly to the head of the machine as shown in FIG. 4.

Figure 2:
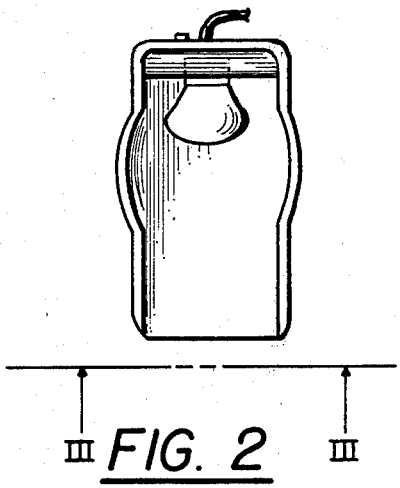
FIG. 2 is a view taken generally on lines II—II of FIG. 1.

The light assembly comprises a housing 12 which has a generally half shell configuration as shown with the walls thereof shaped to define a cavity 26 which is open at one side to be closed by the cover plate 24 or face of the machine. The cavity is open as shown in FIG. 2, and includes an opening 28 at the lower end thereof for directing light to the needle and foot 30 below the head 20 of the machine. As illustrated in FIG. 2, the wall edges of the housing are shaped to conform to the outer configuration of the plate 24 and head 20 of the machine. This provides a uniform extension of the head of the machine and a full cover which may be utilized in lieu of the cover 24.

The light fixture includes a base or socket member 32 mounted in the upper end in a base portion 34 of the housing. A light bulb 36 preferably of the flood light type of configuration mounts within the socket in the usual manner and projects downward toward the light opening 28 for projecting light directly onto the foot and needle of the machine. A power cord 38 of the usual construction providing two or more conductors for electrical power are connected to the light socket and includes a plug or the like 40 connecting to a source of electrical power. The light assembly can include a switch which may be provided in the housing at the base of the light socket or in the cord 38 as preferred.

The housing as shown in FIGS. 2 and 4 defines a cavity which is enlarged at substantially the center thereof to accomodate a light of the type illustrated. The housing member is adapted to be vertically positioned as shown to fit to the head of a sewing machine and present the opening 28 to the lower end thereof for directing the light onto the needle and foot of the machine.

Figure 5:
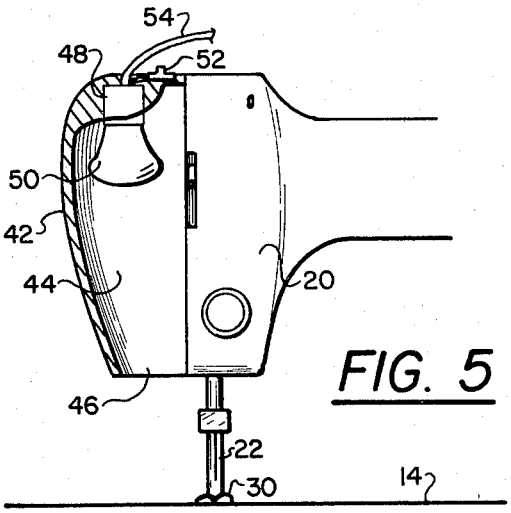
FIG. 5 is a view like FIG. 4 showing an alternate mounting of the light assembly.
Figure 3:
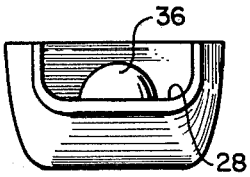
FIG. 3 is a view taken generally on lines III—III of FIG. 2.

Turning to FIG. 5 of the drawings an alternate embodiment is shown wherein a light assembly includes a housing 42 substantially identical in configuration to that of the previous embodiment including a cavity 44 and an opening 46 at the lower end thereof. A light socket 48 includes a light bulb 50 mounted therein. The electrical circuit includes a switch 52 mounted in the housing and adapted to alternately interrupt and complete the circuit for turning the light 50 on and off. A light cord 54 connects to a source of electrical power.

The housing is mounted directly to the head 20 of the sewing machine, the plate 24 having been removed. This embodiment illustrates the light assembly with the light switch included or embodied therein eliminating the necessity for plugging and unplugging the light. Moreover, the housing 14 in this embodiment displaces the cover 24 and serves or functions directly a the cover for the machine.

Thus, while I have illustrated and described my invention by means of a specific embodiment, it is to be understood that numerous changes and modifications may be made therein without departing from the spirit and scope of the invention as defined in the appended claims.

I claim:

1. A sewing machine light assembly for attachment to the head of a machine of the type having a planar vertical end face defined by a removable face plate covering an opening in the end of the head, said light assembly comprising:

a housing having walls defining a generally half-shell configuration with an open side adapted to be mounted on a flat surface on the head of a sewing machine in a vertical position, said housing defining a cavity having an upper closed end defined by an upper wall corresponding to the top of the housing and an enlarged portion intermediate the ends thereof for accommodating a flood light bulb, a lower open end corresponding to the bottom of the housing, a light socket mounted directly to said upper wall and opening downward for receiving a light bulb mounted at the upper end of said cavity and directing light downward toward said lower open end, and an opening at the lower end of said cavity extending the full width of the housing at the lower end thereof for directing light from the cavity onto a needle and foot of a sewing machine.

2. The sewing machine light assembly of claim 1 wherein:

said housing is shaped to selectively fit on either one of directly on said face plate and directly to said housing in place of said face plate.

3. The sewing machine light assembly of claim 2 wherein:

said light assembly includes an electrical circuit for said light, and said circuit includes a switch mounted directly on said housing.

* * * * *